United States Patent [19]

Blacker et al.

[11] Patent Number: 4,701,678

[45] Date of Patent: Oct. 20, 1987

[54] ELECTRON GUN SYSTEM WITH DYNAMIC FOCUS AND DYNAMIC CONVERGENCE

[75] Inventors: Allen P. Blacker, Hoffman Estates; Wayne R. Chiodi, Northbrook, both of Ill.

[73] Assignee: Zenith Electronics Corporation, Glenview, Ill.

[21] Appl. No.: 921,168

[22] Filed: Oct. 20, 1986

Related U.S. Application Data

[63] Continuation of Ser. No. 808,137, Dec. 11, 1985, abandoned.

[51] Int. Cl.[4] ..... H01J 29/58

[52] U.S. Cl. ..... 315/382; 313/449; 313/412; 315/368

[58] Field of Search ..... 315/382, 14, 15, 16, 315/368; 313/414, 412, 449

[56] References Cited

U.S. PATENT DOCUMENTS

| | | | |
|---|---|---|---|
| 2,801,363 | 7/1957 | Sonnenfeldt . | |
| 2,957,106 | 10/1960 | Moodey | 315/13 |
| 3,084,276 | 4/1963 | Severin . | |
| 3,412,281 | 11/1968 | Richards, Jr. et al. . | |
| 3,772,554 | 11/1973 | Hughes | 313/69 |
| 3,952,224 | 4/1976 | Evans, Jr. | 313/414 |
| 3,995,194 | 11/1976 | Blacker, Jr. et al. | 315/16 |
| 4,058,753 | 11/1977 | Blacker et al. | 315/368 |
| 4,334,169 | 6/1982 | Tekenaka et al. | 313/414 |
| 4,473,775 | 9/1984 | Hosokoshi et al. | 315/14 |
| 4,513,222 | 4/1985 | Chen | 313/412 |
| 4,520,292 | 5/1985 | van Hekken et al. | 313/412 |

*Primary Examiner*—Theodore M. Blum
*Attorney, Agent, or Firm*—Ralph E. Clarke, Jr.

[57] ABSTRACT

An electron gun system providing beam convergence is disclosed for use in a color CRT display system. Means including cathode means develop three electron beams, two of which are off-axis with respect to a center axis of the gun. A plurality of electrodes means provide shaping and focusing, and assisting in the converging of the beams at the tube screen. Means are provided for developing and applying to the electrode means a pattern of potentials which form field components in the gaps therebetween; at least one of the electrode means receives a varying dynamic focusing voltage for dynamically focusing the beams as they are deflected across the screen. At least selected ones of the plurality of electrodes means for the off-axis beams are so structured and arranged as to cause a plurality of the field components to be asymmetric and effective to converge the off-axis beams. The strengths of the asymmetric field components vary in response to changes in the dynamic focus voltage. The asymmetric field components according to the invention have such polarity and strength, due to the structuring and arranging of the electrodes, and the application of the pattern of voltages, that a change in the levels of the dynamic focus voltage causes a change in the strength of each of the asymmetric field in a direction effective to additively deflect a common off-axis beam in a common angular direction so as to create a strong dependency of the convergence of the off-axis beams on variations in the focus voltage.

16 Claims, 14 Drawing Figures

ELECTRON GUN SYSTEM WITH DYNAMIC FOCUS AND DYNAMIC CONVERGENCE

CROSS-REFERENCE TO RELATED APPLICATIONS

This application is a continuation of application Ser. No. 808,137 filed Dec. 11, 1985 now abandoned.

This application is related to but in no way dependent upon the following copending applications of common ownership herewith: Ser. No. 754,786 filed July 12, 1985; Ser. No. 754,787 filed July 12, 1985; and Ser. No. 828,568 filed Feb. 21, 1986.

BACKGROUND OF THE INVENTION

This invention relates generally to an improved electron gun system for television receiver cathode ray tubes, and in particular to a system that provides both dynamic focus and dynamic convergence. This invention has applicability to gun systems of many types and constructions, but is believed to be most advantageously applied to systems including three-beam unitized electron guns for color television cathode ray tubes that have an extended field main focus lens. The gun system according to the invention can significantly improve the performance of cathode ray tubes, especially those having a planar, tensed foil shadow mask and associated substantially flat faceplate. The gun system according to the invention is particularly useful in improving the image resolution of flat-faced cathode ray tubes in which degradation of screen corner and edge resolution is particularly troublesome.

Desired picture tube performance characteristics of color television receive systems include high resolution, picture brightness, and color purity. Resolution is largely a function of the size and symmetry of the beam spots projected by the electron guns of the picture tube. Beam spots are desirably small, round, and uniform in size at all points on the picture screen. Achievement of these ideals is difficult because of the many factors which exert an influence on beam spot configuration. As a result of such factors, beam spots that are small and symmetrical at the center point of the picture imaging field can become enlarged and distorted at the periphery of the field, for reasons which will be described.

Key factors which influence beam spot size, uniformity and symmetry in picture tubes having three-beam electron guns include the following:

(a) electron gun design, especially the focusing system;
(b) cathode ray tube screen potential;
(c) magnitude of beam current;
(d) the "throw" distance from the electron gun to the screen; and,
(e) the convergence system.

The subject invention is concerned primarily with focusing and convergence.

The ability of an electron gun to form small, symmetrical beam spots is a major factor in achieving optimum resolution. The task of designing guns with this capability has become more challenging because of the reduction in diameter of the CRT neck. This physical constraint has been largely overcome by new, more effective gun designs, such as the gun having an extended field main focus lens described and claimed in U.S. Pat. No. 3,995,194 assigned to the assignee of this invention.

Convergence of the three beams of an in-line electron gun is provided in present-day television systems primarily by the self-converging yoke. This type of yoke is a hybrid having toroidal-type vertical deflection coils and saddle-type horizontal deflection coils. The yoke contains windings which produce an astigmatic field component that has the effect of maintaining the beams in convergence as they are swept across the screen. The converging effect is shown highly schematically in FIG. 1, in which an electron gun 10 is depicted graphically as emitting three beams 12, 13 and 14 which diverge from a common plane 16 to impinge on a curved screen 18. The three beams are shown as being converged at the center point 20 of the screen 18. Due to the effect of the self-converging yoke, the three beams are also caused to be in convergence at the side of the screen 18, as indicated by point 22, even though the distance that beams must travel from the plane of deflection 16 to point 22 is greater than from the plane of deflection 16 to center point 20 of the screen.

The convergence achieved is not without cost, however, as the beam spots are subject to distortion in the peripheral areas of the screen, as will be shown with reference to FIG. 3. The distortion is acceptable in conventional tubes as the benefits and cost savings of the self-converging yoke outweigh the liabilities.

However, when the screen is flat, as indicated by screen 24 in FIG. 2, the conventional self-converging yoke is unable to maintain beam convergence, as indicated by the spread of the beam spots 28 at the sides 26 of screen 24. In addition to the spread, the spots 28 will be noted as being elongated. This elongation is due primarily to the self-converging yoke. The astigmatic field component, while self-converging the beams, undesirably introduces an astigmatic deflection defocusing of the beams when the beams are deflected away from the screen center point. This effect is indicated diagrammatically in FIG. 3 by beam spots 34. The elongation of the beam spots at the peripheries of the faceplate, and the relative increase in spot size, is indicated in greater detail in the inset figure, FIG. 3A. The beam spots 34 will be seen as comprising a bright core 34A, and transverse to the core, a dim "halo," 34B. The center beam spot 36 is shown to illustrate the magnitude of the spot size increase and distortion at the screen corner. Attempts to focus such beams are largely ineffectual due to the astigmatic effect—focusing merely results in what appears to be a "rotation" of the spot in that the core becomes the halo and the halo becomes the core.

As has been noted, the effect is tolerable in conventional tubes where the screen is curved, as shown by FIG. 1, and it is acceptably within the capability of the self-converging yoke to converge the beams without undue distortion. However, when the screen is flat, as indicated by FIG. 2, the astigmatic effect of the self-converging yoke is no longer tolerable, especially in high-resolution cathode ray tubes. Any attempt to further modify the configuration of the self-converging yoke field to adapt it to a flat screen will inevitably increase distortion outside the limits of acceptability. The self-converging ability of the yoke was already stretched to its limit in its use with the curved screen before the advent of the flat tension mask tube.

Prior art structures for statically converging electron beams have relied upon a variety of techniques such as the use of magnetic influences within and/or outside the tube envelope, and the use of electrostatically charged plates. Also, the prior art shows many examples of causing static beam convergence by inducing an asymmetry in an electrostatic field formed at the interface of two spaced electrodes. Prior art techniques for inducing electrostatic field asymmetry have included offsettting the opposing faces of two electrodes, and slanting one or more of the opposing faces so that the space lying between is in the form of a wedge—techniques described in U.S. Pat. No. 4,058,753 of common ownership herewith, and in U.S. Pat. No. 2,957,106.

Dynamic convergence means is described in U.S. Pat. No. 3,448,316. Three in-line electron beams generated by three cathodes cross over in the electrostatic field of a main lens. The center beam (green) follows a straight-line path, but the two outer red and blue beams exit the lens in divergent paths. The beams paths are reflected convergingly by electron mirrors located beyond the beam's exit from the gun. The potential on two outer plates of the mirrors is adjustable to provide for static convergence of the red and blue beams at the shadow mask. The center beam is unaffected as the potential on two inner plates through which it passes is left unchanged. Dynamic convergence is attained by changing the convergence control voltage on the outer two plates at the horizontal scanning frequency. The waveform of the convergence voltage is in the form of a parabola.

In U.S. Pat. No. 4,520,292 von Hekken et al discloses means formed in the screen grid of an electron gun for urging the outer two beams of a three-beam electron gun into convergence with the center beam. The screen grid configuration includes a transversely disposed recessed portion having a substantially rectangular center portion and substantially triangular end parts. The total effect is to the tilt the field lines within the recessed portion so that the outer beams converge.

In U.S. Pat. No. 4,058,753, of common ownership herewith, there is disclosed a three-beam electron gun for a color cathode ray tube having an extended field main focus lens means. The focus lens means has for each beam at least three electrodes including a focus electrode for receiving a variable potential for electrically adjusting the focus of the beam. In succession down-beam, there are at least two associated electrodes having potentials thereon which form in the gaps between adjacent electrodes significant main focus field components. To adjust beam focus, the strength of a first of these components is controlled by adjustment of the voltage received by the focus electrode. The strength of the second of the field components is relatively less than that of the first component. Each of the lens means is characterized by having addressing faces of the associated electrodes which define the second field component being so structured and disposed as to cause the second field component to be asymmetrical and effective to significantly divert the beam from its path in convergence of the beams without any significant distortion of the beam and substantially independently of any beam-focusing adjustments of the first field component. Electrode structures defined for producing asymmetric field components include a gap angled forwardly and outwardly, a wedge-shaped gap, and radially offset apertures.

Takenaka et al in U.S. Pat. No. 4,334,169 shows embodiments of an electron gun with a three-element main focus lens (G1, G2 and G3) and outer beam converging means at the field between the center electrode (G2) and the accelerating electrode (G3) of the main focus lens. The convergence means comprise offset apertures and apertures lying at an angle with respect to the gun axis to render the field between asymmetric. The G1 and G2 electrodes are electrically linked and receive the focusing voltage. An aperture electrode is located intermediate to G1 and G2 of the main focus lens and is electrically linked to the accelerating electrode of the prefocusing section. The object is stated to be the maintenance of the pre-established convergence of the outer beams, despite changes in the focusing voltage.

Other representative disclosures having electrode structures that influence beam convergence include:

U.S. Pat. No. 3,952,224 to Evans
U.S. Pat. No. 3,772,554 to Hughes
U.S. Pat. No. 4,473,775 to Hosokoshi et al
U.S. Pat. No. 4,513,222 to Chen The performance of cathode ray tubes is also a function of the ability of the gun and associated systems to establish and maintain focus at all points on the screen. Conventional curved-screen, curved-mask tubes, because of the curvature of the screen, are able to attain tolerable focusing performance on all points on the screen without the need for dynamic focusing. However, tubes having a flat faceplate exacerbate the focusing problem particularly at the screen edges due to the lack of curvature of the screen. For high-performance flat-faced tubes, dynamic focusing of electron beams is a necessity.

Techniques for dynamically varying the focus of electron beams are well-known in the art. Dynamic focusing is used to cause a beam to be in focus at the sides of the picture imaging field as well as at the center of the field. The need for dynamic focusing arises from the aforedescribed arcuate scanning of the beam with relation to the relatively planiform faceplate.

Dynamic focusing of a beam can be accomplished electronically by means of a focus-control signal modulated at the scanning frequency, with the signal being applied to a suitable beam-focusing electrode. Dynamic focusing means is disclosed by Richard in U.S. Pat. No. 3,412,281. An A.C. control signal is employed which is proportional to the distortion due to defocusing inherent in tube faces, according to Richard. The A.C. control signal is converted into a D.C. control signal which may be added to the relatively high-level constant voltage of the tube focusing circuit. Other approaches to dynamic focusing are disclosed by U.S. Pat. Nos. 2,801,363 and 3,084,276.

OBJECTS OF THE INVENTION

It is a general object of the invention to provide an improved electron gun system for color cathode ray tubes, especially those having a planar tension mask and flat screen.

It is another object of the invention to provide dynamic convergence as well as dynamic focusing in electron gun systems having dynamic focusing capability.

It is further object of the invention to provide in a color cathode ray tube with a self-converging yoke an electron gun system having dynamic focusing, the system having the property that in the process of providing the dynamic focusing, a meausre of dynamic convergence is attained sufficient to significantly reduce the self-convergence demands on the associated yoke.

It is another specific object of the invention to provide an electron gun system that enhances the symmetry of beam spots in peripheral areas of the screen when the beams are converged primarily by a self-converging yoke.

BRIEF DESCRIPTION OF THE DRAWINGS

The features of the present invention which are believed to be novel are set forth with particularity in the appended claims. The invention, together, with further objects and advantages thereof, may best be understood by reference to the following description taken in conjunction with the accompanying drawings, in the several figures of which like reference numerals identify like elements, and in which:

FIG. 5B–1 is an enlarged view of a section of FIG. 5B showing additional details of the paths;

DESCRIPTION OF THE PREFERRED EMBODIMENTS

The present invention can be applied to electron gun systems of several different types, both unitized and non-unitized. However, the illustrated embodiments according to the invention are in-line unitized guns as these types are in more general use in color cathode ray tubes. In the context of the multi-beam color cathode ray tube concept, this invention may be employed to assist the self-converging yoke in dynamically converging the off-axis beams all over the screen in common conjunction with the center beam. The convergence means according to the invention is applicable to color tubes of various types including home entertainment television tubes, and in medium-resolution and high-resolution tubes used in color monitors.

Figure 4:
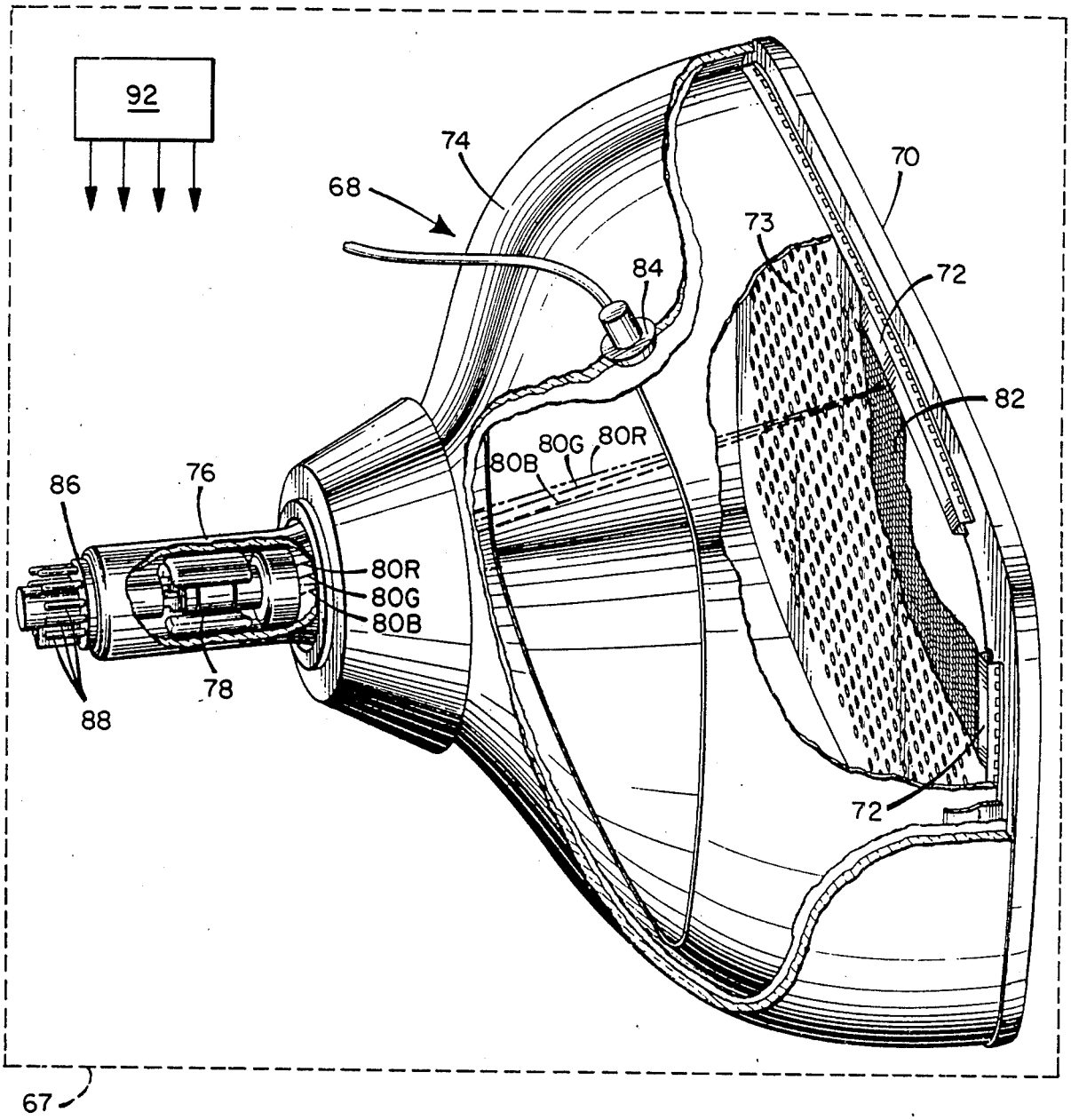
FIG. 4 is a view in elevation and partially in section of a cathode ray tube having a planar shadow mask and associated faceplate, with a television or display system represented schematically by the enclosing dashed line, and in which the gun system according to the invention can be utilized.

A color cathode ray tube having a planar shadow mask and flat faceplate, to which the present invention is applicable, is depicted in FIG. 4. This concept is the subject of referent copending applications Ser. Nos. 754,786; 754,787; Ser. No. (D5329), and U.S. Pat. No. 4,547,696, of common ownership herewith. A TV receiver system 67 is depicted in FIG. 4 as having a cathode ray tube 68 with a substantially flat glass faceplate 70. A shadow mask support frame 72 is represented as being attached to faceplate 70 for supporting a shadow mask 73. Faceplate 70 is joined to a rear envelope section of tube 68, here shown as a funnel 74 which tapers down to a narrow neck 76. Neck 76 is shown as enclosing an electron gun 78 which is indicated as projecting three electron beams 80R, 80G, and 80B on to the inner surface of faceplate 70, comprising the screen 82. Screen 82 has a pattern of three compositions of phosphors deposited thereon which emit red, green and blue light when excited by the respective electron beams 80R, 80G, and 80B. An anode button 84 provides for the entrance of a high electrical potential for tube operation. Relatively lower electrical potentials for operation of the electron gun 78 are conducted through the tube base 86 by means of a plurality of conductive pins 88. As shown by FIG. 4, a yoke 90, noted as being a self-converging yoke, provides for the scanning of the electron beams 80R, 80G and 80B across the screen 82 of faceplate 70 to selectively excite the phosphors deposited thereon through the foraminous medium of the shadow mask 73.

The three electron beams 80R, 80G and 80B of tube 74 are caused to scan a raster on the respective phosphor deposits on screen 82. The beams are modulated; that is, the beam currents are varied to form the picture. Beam scanning is a produce of horizontal and vertical scansion circuits by which scanning signals are applied to the yoke of the tube, all as is well known in the art.

The circuits that provide potentials for cathode activation, beam scanning, and beam luminance, and which form field components in the gaps between adjacent electrodes, are indicated schematically by block 92. As has been noted, the potentials are applied to the gun components by way of ones of the conductive pins 88. The circuits also provide a variable signal for operation of the dynamically converging and focusing gun system according to the invention, as will be described.

Figure 5:
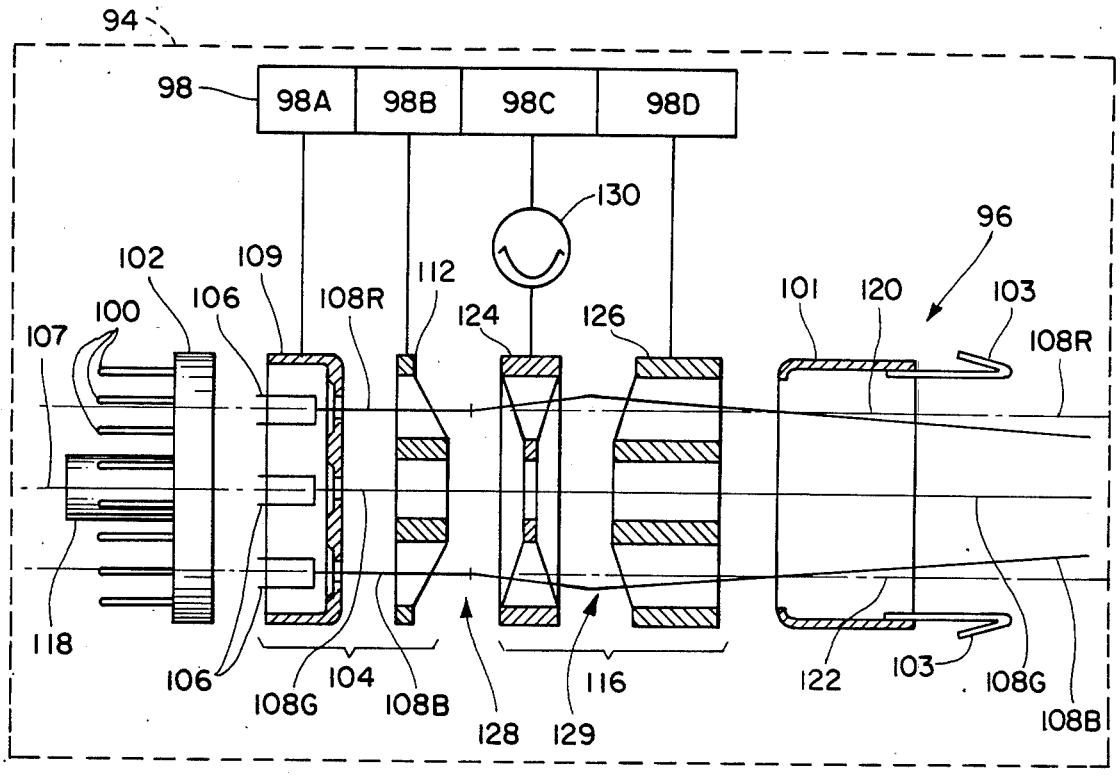
FIG. 5 is a schematized top view of a self-converging gun system according to the invention, one that has a three-element extended field main focus lens; the system aspect is indicated by the enclosing dashed line.

An electron gun system 94 for dynamically focusing and converging the electron beams according to the invention is depicted in FIG. 5. The gun system 94 comprises an electron gun 96, and means 98 for developing and applying to the plurality of electrode means a pattern of electrical potentials which form field components in the gaps therebetween. The means are indicated schematically by the block 98. A plurality of electrode means for each beam, shown as being four in this example, provide for shaping and focusing and assisting in the convergence of the beam at the screen of the tube according to the invention.

As noted, the potentials are normally conducted to the electrodes of gun 96 through selected ones of the electrically conductive pins 100 that pass in airtight seal through electrically insulative base 102 of tube 96. In this diagram, however, the potentials are indicated for illustrative purpose as being conducted directly from the means 98 for applying the potentials directly to the electrodes. The very high potential (e.g., 20–30 kV) applied to the final, or "anode" electrode, is typically routed through the anode button in the tube envelope (see Ref. No. 84 in FIG. 4) to the conductive coating on the inner surface of the funnel, from whence the potential is conductive to the final, anode electrode of the gun through a cup-shaped electrode 101, and a plurality of gun-centering springs 103 extending from the front of the electrode 101.

In the preferred embodiment of the invention, electron gun 96 comprises means 104 for developing three in-line electron beams 108R, 108G and 108B parallel to the center axis 107 of gun 96. The means 104 for developing the beams is commonly referred to as the "prefocusing section," which includes the cathode means 106, and electrode means 109 and 112 commonly referred to respectively as the "control grid" and the "accelerating grid." The three beams are generated by thermionic emission of the cathode means 106 as is well known in the art.

Two main focus lens means 116 receive the three in-line beams 108R, 108G and 108B for focusing and assisting in the convergence of the beams at the screen of the tube according to the invention. The main focus lens mains 116 each have a like plurality of main focus electrode means spaced along a lens axis parallel to the other lens axes and parallel to a gun center axis 107. Center beam 108G is noted as being in alignment with the gun center axis 107. Please note also that the term "main focus lens means" refers to the focus lens structure employed to focus all the beams. The term "main focus electrode means" refers to a discrete individual focus electrode for a single beam, or an allotted portion of a unitized electrode common to others of the beams. The main focus lens means depicted in FIG. 5 is a two-element bipotential lens.

Two of the lens axes, shown in FIG. 5 as being two axes—lens axis 120 and lens axis 122—are shown as being "off-axis" with respect to the gun center axis 107. Each focus lens means is shown as including a focus electrode means 124, and a second electrode means 126 adjacent to focus electrode means 124 on the side away from cathode means 104. Second electrode means 126 may comprise an "anode electrode" for receiving a high voltage for beam acceleration.

A third electrode means, which bears the reference number 112, is provided for each beam. Third electrode means 112 is depicted as being located adjacent to focus electrode means 124 on the side toward cathode means 104.

Means are provided according to the invention for developing and applying to the focus electrode means 124, and to the second electrode means 126 and third electrode means 112, electrical potentials which form field components in the gaps between third electrode means 112 and the focusing electrode means 124, and between focus electrode means 112 and the second electrode means 126. The electrode means cited is so structured and arranged as to cause the field components therebetween to be asymmetric and effective to converge off-axis beams 108R and 108B. The strength of the first and second asymmetric field components vary in response to changes in the dynamic focus voltage applied to the focus electrode 124.

The means for developing and applying the potentials, indicated schematically by the block 98, provide the following typical, fixed potentials:

| Block No. | Potential, V | Applied to Electrode |
|---|---|---|
| 98A | 0 | 109 |
| 98B | 725 | 112 |
| 98C | 7,000 | 124 |
| 98D | 25,000 | 126 |

The potential applied to the focus electrode is not truly fixed, but is adjustable both statically and dynamically according to the invention. With regard to static adjustment of the potential, the potential is made manually variable in the range of ±400 volts e.g. for use in the manufacturing and servicing "set-up" process, in which the three beams are focused at the center of the screen. Once established, this potential is left unchanged unless further servicing is required.

Means are provided according to the invention for developing and applying a varying dynamic focus voltage to focus electrode means 124 for each beam to dynamically focus the beams as they are deflected across the screen. This dynamic focusing voltage is in the form of a parabola, as indicated schematically by the encircled parabola 130.

At least selected ones of the plurality of electrode means for each of the off-axis beams 108R and 108B are so structured and arranged as to cause a plurality of the field components to be asymmetric and effective to converge off-axis beams 108R and 108B. The strength of the asymmetric field components vary in response to changes in the dynamic focus voltage applied to the electrode means.

In the FIG. 5 embodiment of the invention, the plurality of electrode means for each of the off-axis beam 108R and 108B are so structured and arranged according to the invention as to create a first asymmetric field 128 in the paths of beams 108R and 108B. The location of the first asymmetric field is indicated by the arrow. Also according to the invention, a second asymmetric field 129 is created in the path of beams 108R and 108B. The strengths of the two separate asymmetric fields 128 and 129 varies according to the invention in response to changes in the dynamic focus voltage 130 applied to the focus electrode means 124.

The structure and arrangement of the electrode means 112, 124 and 126 for forming the first and second asymmetric fields 129 and 130 are depicted as being electrode configurations in which the addressing faces of the off-axis electrodes are parallel and angled relative to the central axis 107 so as to create the desired asymmetries.

Pertinent aspects of the subject invention will now be described. This invention concerns an electron gun system which provides dynamic focusing and dynamic converging capabilities. In the system of the present invention, dynamic focusing is provided to assure maintenance of beam focus at all points on the screen. As a result of the novel construction of the gun, and as a result of the application of a dynamic waveform to the focus electrode to the end of providing dynamic focusing, as a beneficial byproduct, a measure of dynamic beam convergence is also achieved. Color cathode ray tubes today are typically used with self-converging yokes in order to reduce system costs. As described above, the capabilities of existing selfconverging yokes to provide self-convergence all over the screen has been strained to the limit in conventional tube systems having curved faceplates. With the advent of flat faceplate tubes, present self-converging yoke designs are unable to provide satisfactory self-convergence at the screen edges without unacceptable degradation of the beam spot and shape in those regions. By the provision of the present invention, the measure of dynamic convergence which is achieved as an intended byproduct of the application of a dynamic focusing voltage to the focus electrode is such as to reduce the convergence demands on the yoke to the point where existing self-converging yokes can provide acceptable convergence at all points on the screen. The asymmetric field components have according to the invention such polarity and strength due to the structuring and arranging of the electrodes, and the application of the pattern of voltages, that a change in the level of the dynamic focus voltage causes a change in the strength of the asymmetric field components in a direction effective to additively deflect a common off-axis beam in a common angular direction. As a result, a strong dependence of the convergence of the off-axis beams on variations in the focus voltage is created, whereby a portion of the self convergence desired to be attained in the CRT system according to the invention is achieved by the converging of the beams as the beams are dynamically focused. The self-convergence demands on the yoke are thereby reduced.

As discussed in the foregoing, in the patent to Takenaka et al, U.S. Pat. No. 4,334,169, an electron gun has electrodes designed such as to create static convergence of the beams by means of asymmetrical fields formed in the gun. In order to immunize static beam convergence from adjustments in static focus voltage, the Takenaka et al gun creates offsetting asymmetrical fields which cancel out any efforts static focus adjustments have on static convergence. In other words, Takenaka et al sought to achieve exactly the opposite effect as we are achieving by this invention, and further, has only to do with static effects. Rather than taking measures to avoid focus effects on convergence, in our system the convergence dependence on focus changes is caused to be strong.

Figure 5C:
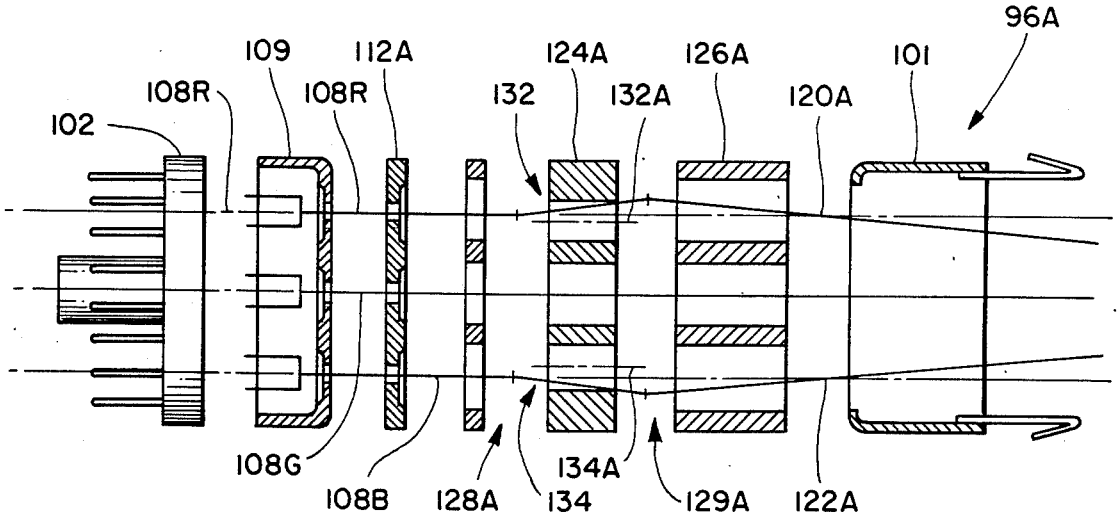
FIG. 5C is a view similar to FIG. 5 that depicts an alternate electrode structure for attaining the objectives of the invention.
Figure 5A:
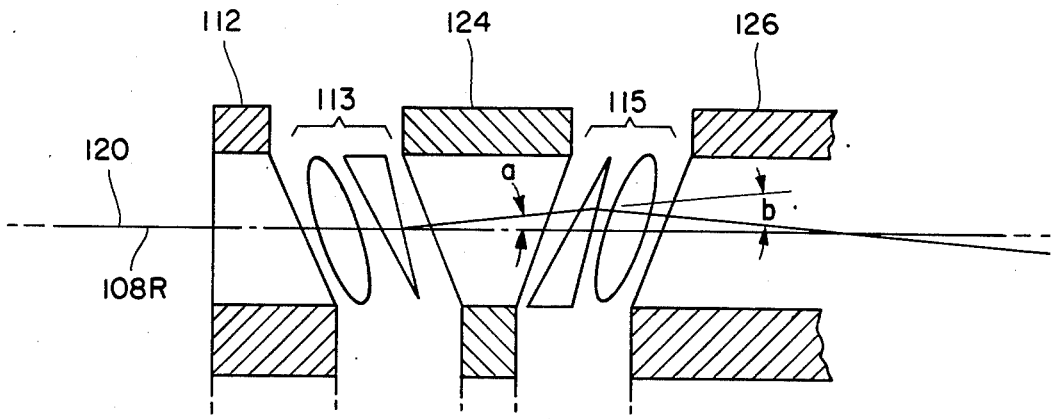
FIG. 5A is an enlarged fragmentary view of FIG. 5.

This effect can be better understood by reference to FIG. 5A which shows in an enlarged scale the upper portion of the FIG. 5 electron gun 96 through which the beam 108R passes. A first asymmetrical field component 113 is created between electrodes 112 and 124, and a second component 115 created between electrodes 124 and 126 (FIG. 5), may be thought of as having the beam-focusing lens and beam-diverting wedge constituents as shown. As indicated schematically, an electron beam 108R entering the first asymmetric field component 113 is diverted through an angle "a" from the lens axis 120. Beam 108R is then diverted in the opposite direction through an angle "b" upon entering the second asymmetrical field component 115. It can be seen that in accordance wtih this invention, the effects of both asymmetrical field components is to deflect the beam additively and thus exacerbate in a beneficial way the convergence dependence on focus voltage changes. In the aforedescribed Takenaka U.S. Pat. No. 4,334,169, the asymmetrical fields establish conteracting and cancelling effects on the beam such as to immunize any convergence dependence on changes in static focus voltage.

Figure 1:
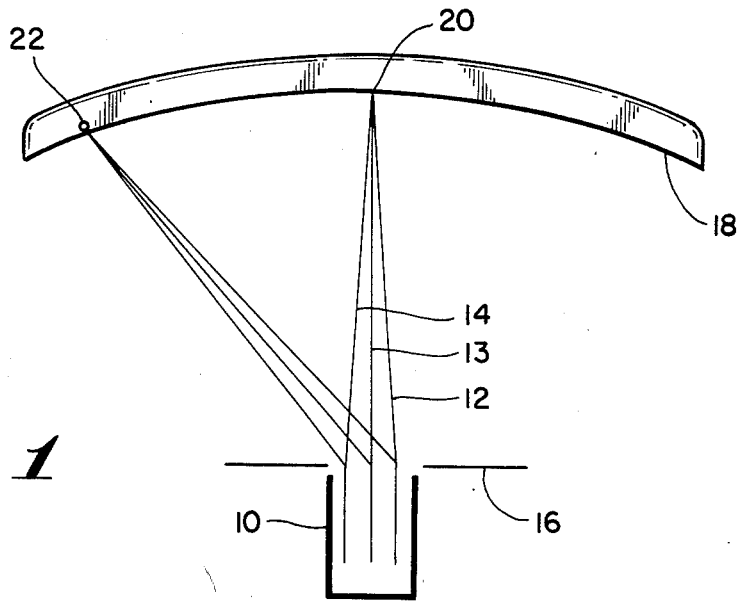
Fig. 1 PRIOR ART
FIG. 1 is a schematic representation of a desired effect of beam convergence on a curved screen due to the astigmatic convergence field components of the self-converging yoke.
Figure 2:
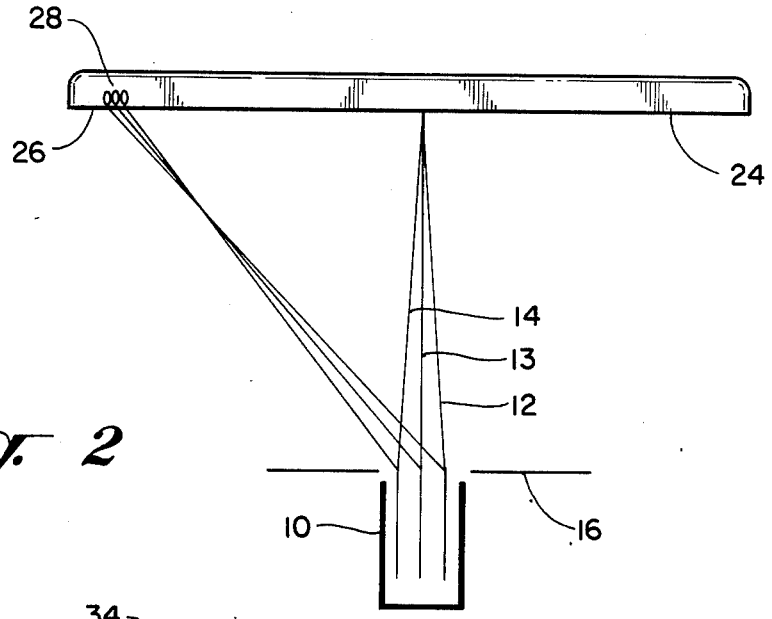
FIG. 2 depicts schematically the undesired effect of the self-converging yoke on beam convergence in peripheral areas of the screen of a cathode ray tube having a flat faceplate.
Figures 1, 5B:
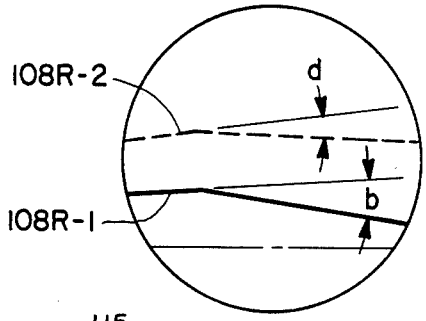
FIG. 5B is view based on FIG. 5 showing diagramatically the paths of the two off-axis beams in response to a change in focus potential according to the invention.
Figure 5B:
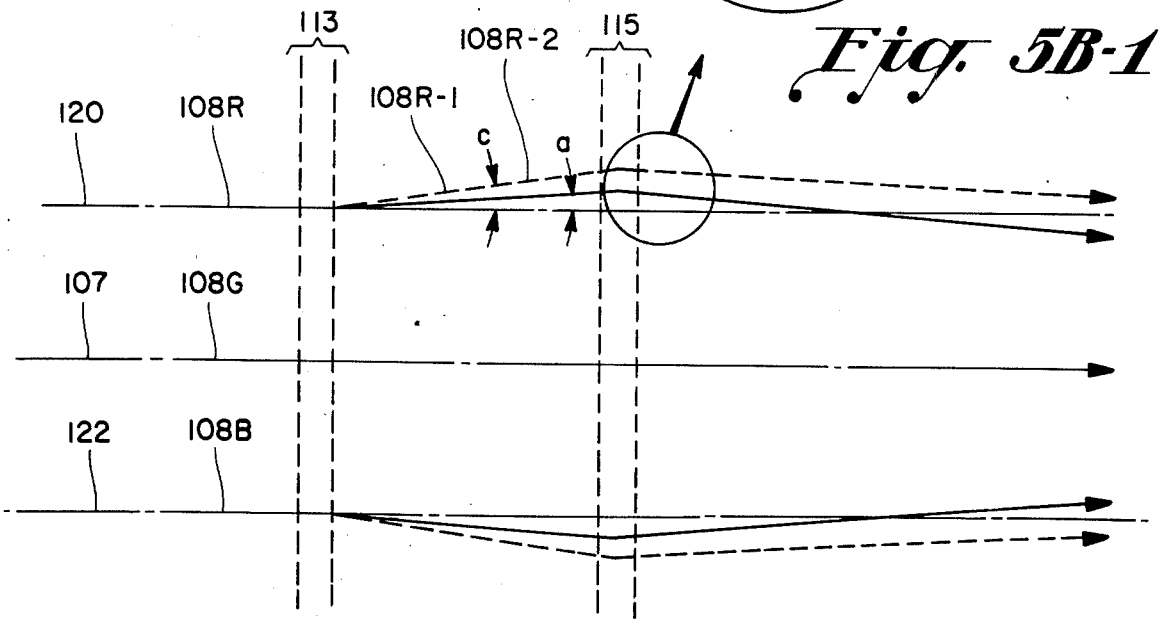

The effect according to the invention, in which convergence dependence on changes in focus voltage is rendered strong, is illustrated diagrammatically in FIG. 5B. An insert figure, FIG. 5B-1, provides an enlarged view of the details of beam convergence in the second asymmetric field 115. Three electron beams 108R, 108G and 108B are indicated as passing through first and second asymmetric fields 113 and 115, indicated respectively by the double dash lines. In both of the fields 113 and 115, the electrical potential increases from left to right; i.e., the electrons are accelerated. Beam 108G, depicted as being the center beam—one that lies along the center axis 107 of the gun—is shown as being undiverted. The two off-axis beams 108R and 108B are represented as being diverted along two different paths before emerging from the asymmetric fields as converging beams. Under a first condition of focus potential, in which beam 108R is represented as a solid line and designated as beam 108R-1, beam 108R-1 is shown as being diverted from the beam axis 120 by an angle "a" as a result of passing through first asymmetric field 113. In passing through the second asymmetric field 115, beam 108R-1 is diverted in an opposite direction by an angle "b". (See inset, FIG. 5B-1.)

The dash line representation of beam 108R (designated as 108R-2) may be considered as occurring under a second condition of focus potential in which the potential is appreciably greater than under the first condition. Under this condition, beam 108R-2 is shown as being diverted in passing through first asymmetric field 113 by an angle "c" from beam axis 120; angle "c" is noted as being greater than angle "a". This is due to the fact that increasing the potential on the focus electrode increases the strength of asymmetric field 113. In passing through the second asymmetric field 115, beam 108R-2 is diverted from its path by an angle "d" (see inset figure). Angle "d" will be noted as being less than angle "b". This is due to the fact that increasing the focus potential decreaes the strength of asymmetric field 115. This second condition would occur as the beams are scanned radially outwardly from the center of the screen to remain in convergence (and focus) at all points on the screen. The identical conditions and angles described for beam 108R apply as well to beam 108B. The configuration of beam 108B can be considered to be a mirror image of beam 108R.

At least one or both of the separate asymmetrical fields could as well be created by offsetting the apertures in the addressing faces. Such an offset aperture configuration is shown in the FIG. 5C embodiment. The FIG. 5C embodiment may be considered to be like the FIG. 5 embodiment, except where noted. The aperture 132 and aperture 134 of the off-axis beams 108R and 108G, located in focus electrode 124A, are depicted as being offset or "out of alignment" with the respective lens axes 120A and 122A. The offset condition is indicated by the centerlines 132A and 134A of apertures 132 and 134. The structure and arrangement means for creating the first and second asymmetric lenses is not confined solely to one or the other of the means; that is, offset apertures may as well be used to create one of the asymmetric fields, and angled addressing faces the other asymmetric field. Also in accordance with the invention, both offset apertures and angled addressing faces may be used in conjunction to create an asymmetric field when a very strong field is desired.

Thus it can be seen that asymmetric fields 113 and 115 are such that the change in the level of the focus voltage, as occurs during dynamic focusing of the beams during deflection, causes a change in the strength of each of the asymmetric fields 113 and 115. The change in the strength of the fields 113 and 115 is in a direction to additively deflect a common beam in a common angular direction. This creates a strong dependency of the convergence of the off-axis beams on variations in focus voltage.

Figure 6:
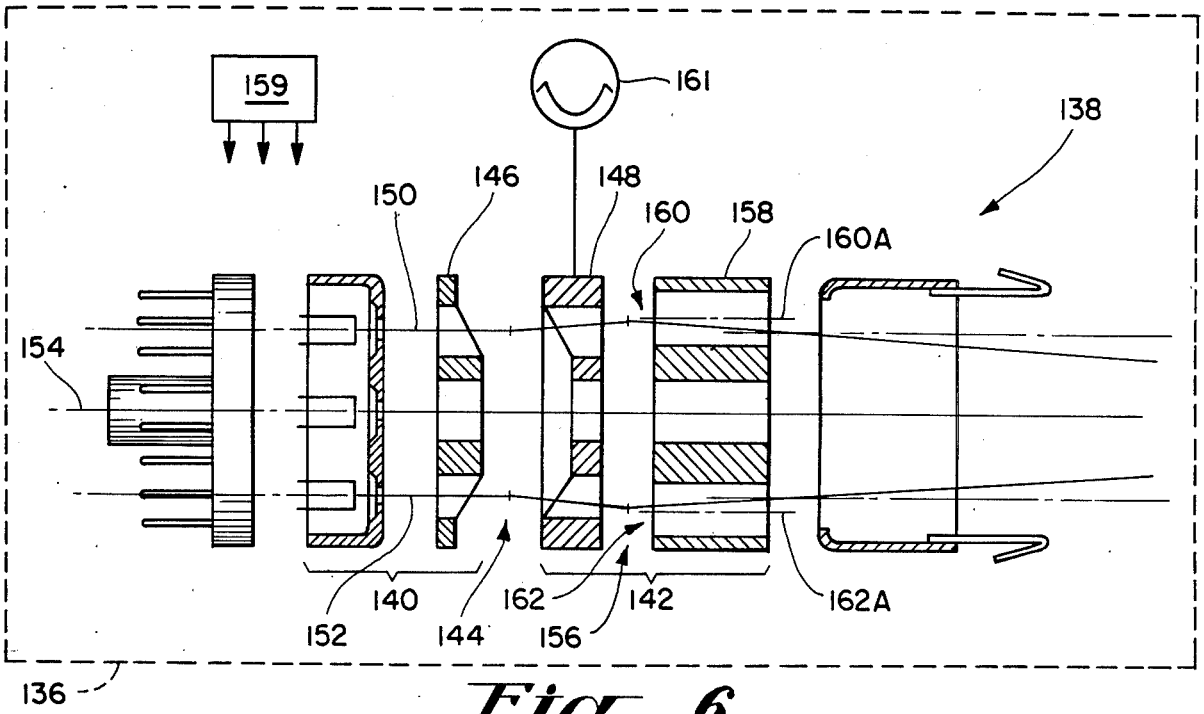
FIG. 6 is a view similar to FIG. 5, except that there is depicted an electron gun showing a combination of means for attaining the objectives of the invention.

This is very different than in the aforediscussed U.S. Pat. No. 4,334,169 to Takenaka et al wherein a pair of asymmetric fields are created which have a polarity and strength which is such that changes in the level of static focus setting produces changes in the strength in the asymmetric fields effective to offset or cancel any beam deflection. Takenaka et al has a primary objective to "provide an electron gun system which, in response to controlling the focus electrode voltage, deflects the electron beam at one angle to compensate for the deflection of the beam at another angle." In other words, changes in the level of focus voltage *do not* affect beam convergence; that is, dependence of convergence on focus adjustments is eliminated. By our invention, the dependence of convergence on focus voltage changes is aggravated for the beneficial result of inducing a measure of beam convergence as a result of the application of a dynamic focus voltage. An example of an electron gun system 136 with a gun 138 according to the invention having both offset apertures and angled addressing faces is shown by FIG. 6. Electron gun 138 is similar to the gun 96 shown by FIG. 5 in that it has a bipotential main focus lens 142. A first asymmetric field 144 is formed between a prefocusing electrode 146 and the adjacent focus electrode 148. The means for forming the first asymmetric field 146 is depicted as being the structure and arrangement of the addressing faces of each of the electrodes 146 and 148 for off-axis beams 150 and 152 in that the faces are parallel and angled relative to the central axis 156 of gun 138. A second asymmetric field 156 is formed between focus electrode 148 and the adjacent anode electrode 158. The means for forming the second asymmetric field 156 is depicted as being the offsetting of the apertures 160 and 162 of the off-axis beams 150 and 152. The offsetting is indicated by the centerlines 160A and 162A of apertures 160 and 162. Also as described heretofore in connection with the gun system 94, shown by FIG. 5, gun system 136 has a source of electrical potentials for operation of the gun system, as indicated schematically by block 159. Further, a dynamic focusing voltage indicated schematically by parabola 161 provides for varying the strengths of the two asymmetric fields according to the invention.

Figure 7:
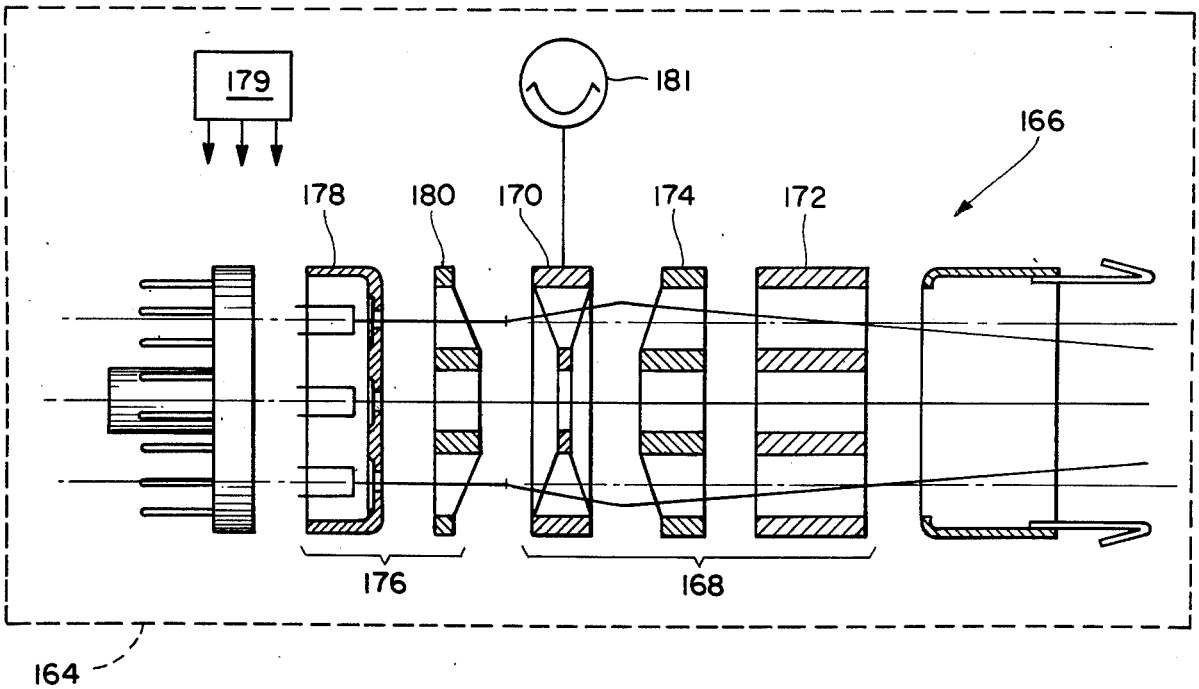
FIG. 7 is a schematized top view of a dynamically converging gun system according to the invention having a three-element extended field main focus lens.
Figure 8:
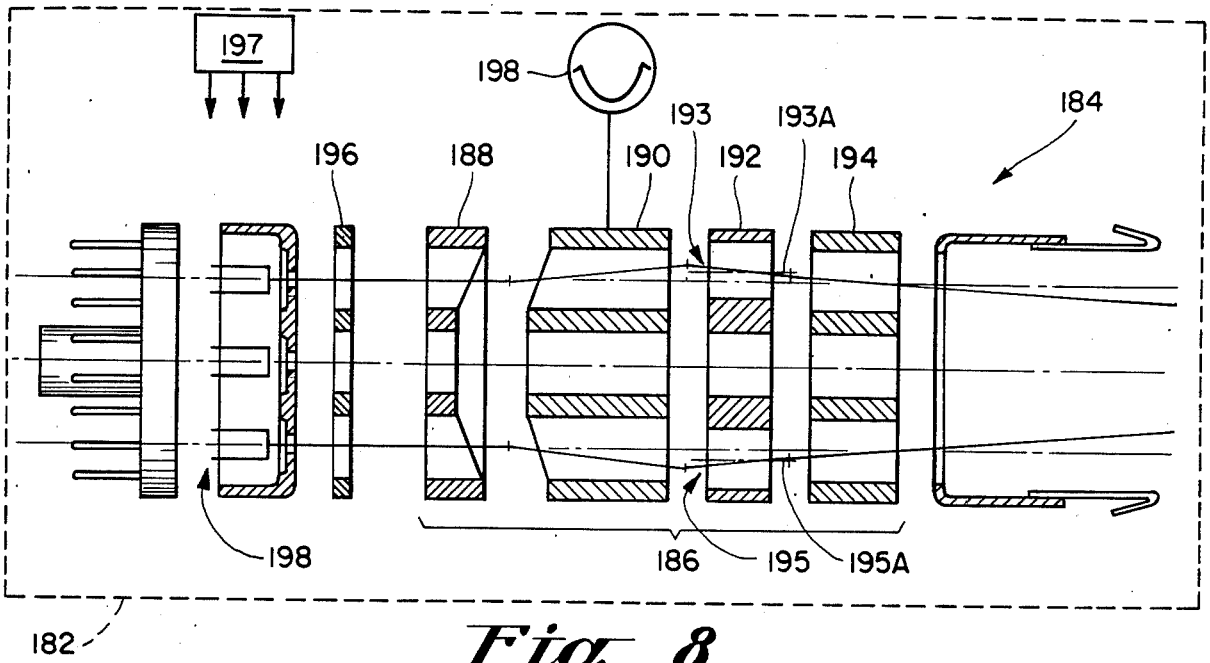
FIG. 8 is a view similar to FIG. 7 except that the main focus lens of the electron gun of the system according to the invention has a four-element extended field lens.

The inventive concept of the dynamically self-converging gun system according to the invention is equally applicable to other types of electron guns in addition to the bipotential guns 96 and 138 depicted in FIGS. 5 and 6. For example, the system according to the invention can find useful application with electron guns having the extended field main focus lens which may have e.g. three or four main focus lens elements, as illustrated in FIGS. 7 and 8, respectively. Electron guns having the extended field main focus lens, and their principles of operation, are fully described and claimed in U.S. Pat. Nos. 3,895,253; 3,995,194, and 4,058,753, all of common ownership herewith.

With reference to FIG. 7, there is represented an electron gun system 164 with an electron gun 166 having a main focus lens 168 depicted as having a focus electrode means 170, anode electrode means 172, and an intermediate electrode 174 shown as being situated between focus electrode means 170 and anode electrode means 172. Gun 166 has a prefocusing section 176 comprising a control electrode means 178 and accelerating electrode means 180. Electrode means 180, focus electrode means 170, and intermediate electrode means 180 of the main focus lens 168 are represented as being so structured and arranged according to the invention as to create first and second asymmetric fields therebetween whose strength varies in response to changes in the focus voltage applied to focus electrode means 170—all as described heretofore in connection with the description of the invention associated with FIGS. 5 and 6. Gun system 164 has a source of electrical potentials for operation of the gun system indicated schematically by block 179. A dynamic focusing voltage indicated schematically by parabola 181 provides for varying the strengths of the two separated asymmetric fields according to the invention.

The inventive means applies as well to extended field electron guns having more than the three main focus lens electrodes depicted in FIG. 7. THe embodiment of FIG. 8 shows an electron gun system 182 having and electron gun 184 with a four-element main focus lens according to the invention; as with electron gun shown by FIG. 7, the description of this gun is limited only to those portions of the gun which are substantially different from the electron gun 166 having an extended field main focus lens depicted in FIG. 6. The main focus lens 186 of electron gun 184 is represented as having first, second, third and fourth electrode means, numbered respectively 188, 190, 192 and 194. The pattern of potentials on the respective electrodes follows this relationship: first electrode means—medium; second electrode means—low; third electrode means—medium; and fourth electrode means—high. An electron gun having the lens shown by FIG. 8 is described and claimed in reference U.S. Pat. No. 3,995,194. The prefocusing electrode means 196 is located adjacent to first electrode 188 on the side toward cathode means 198. The principles according to the present invention of the interaction between electrodes 196 and 188, and 188 and 190 are as described heretofore in conjunction with FIGS. 6 and 7. Also as described heretofore in connection with the previous gun systems, gun system 182 has a source of electrical potentials for operation of the system as indicated schematically by block 197, and a dynamic focusing voltage indicated schematically by parabola 198 that provides for varying the strengths of the two asymmetric fields according to the invention. Apertures 193 and 195 of electrode 192 are depicted as being offset with reference to the cetner axis of the beams; the offsetting is indicated by the centerlines 193A and 195A of apertures 193 and 195.

In company with other standard circuits for reproducing television signals, the application and operation of which are well known in the art, the electron gun system with dynamic focus and dynamic convergence according to the invention has means for developing horizontal and vertical scansion circuits, and deriving a variable dynamic focusing signal from them. This signal, in the context of this invention, provides both dynamic focusing and dynamic convergence.

Monitor and television receiver systems in which the inventive concept can be advantgeously employed comprise well-known types; as a result, details as to the best mode of implementation of the invention can be devoted to a simplified description of a suitable circuit. Although similar in function, details of the types of components used, the specific circuit values, and the operating values of input and output signal voltages thereof will different significantly among the many brands of television receiver systems and monitors currently available. So a description of a basic functional circuit is supplied, the details of which can be readily provided and implemented by one skilled in the art in adapting basic video circuits to specific receiver and monitor systems.

Figure 9:
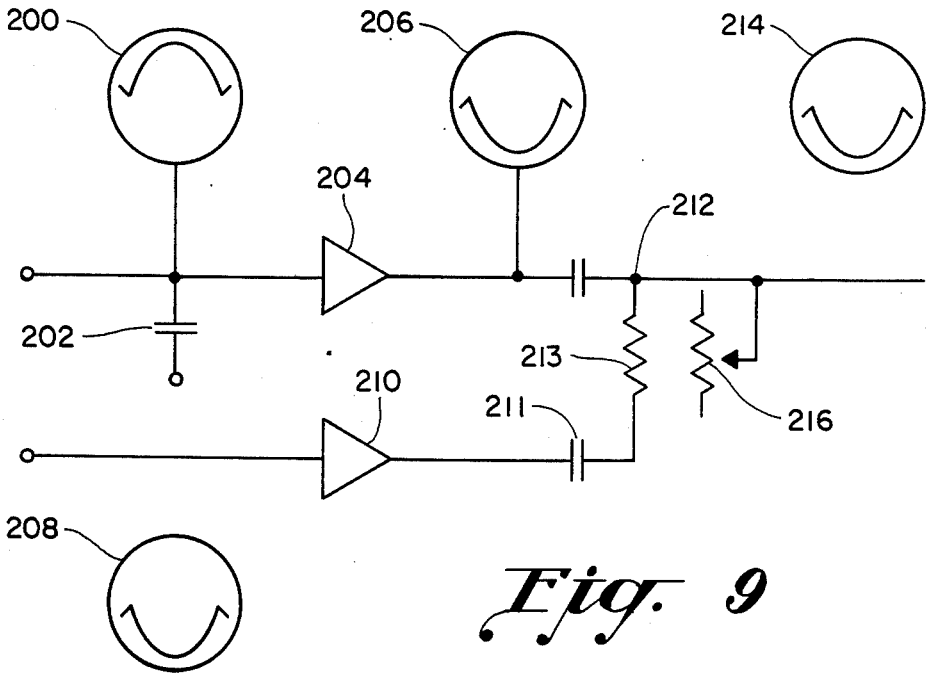
FIG. 9 is a schematic diagram of circuit means for forming a dynamic beam focusing and convergence signal utilized according to the principles of the invention.

The dynamic focusing and convergence signal is essentially a combination of the parabolic waveform developed by the horizontal and vertical sweep circuits of the television receiver (or monitor) system. With reference to FIG. 9, which shows schematically the waveform-combining circuit means, there is depicted a fast horizontal sweep waveform 200. This waveform can be taken by sampling the output of the "S" (sweep) capacitor 202 common to most televison sweep circuits. Waveform 200 is in the form of a parabola; the frequency is typically 15 kHz. Amplifier stage 204 provides for amplification of the sweep waveform to a high voltage. The ouput waveform 206, shown as being an inverted parabola, has an amplitude of 500 volts, by way of example.

The parabola 208 represents the vertical sweep waveform and is taken form a sutiable point in the vertical sweep circuits. It is a "slow" parabolic waveform having a frequency of 60 Hz. The signals are amplified in amplifier 210 to about 500 volts. The outputs of both amplifiers are AC-coupled to the final output as indicated, with the combining taking place at point 212. Capacitor 211 provides for signal coupling, and resistor 213 provides for isolation. The composite signal waveform 214 provides for both dynamic focusing and convergence according to the invention by application of the signal to a specified electrode of the main focus lens, as has been described; for example, the focus electrode means 170 in FIG. 7. The voltage level is controlled by a resistive network 216, indicated highly schematically.

Figure 3:
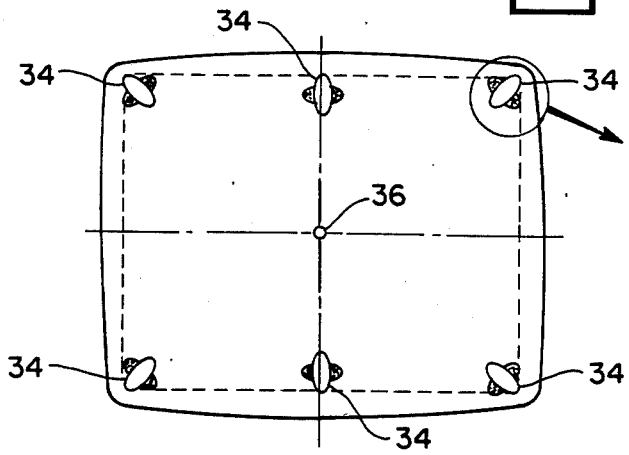
Fig. 3 PRIOR ART
FIG. 3 is a schematic representation of undesired beam spot configuration in corner areas of the screen attributable to the self-converging yoke.
Figure 3A:
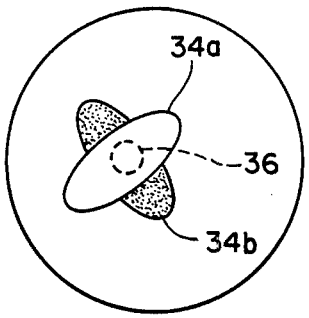
FIG. 3A is an enlarged view of the undesired beam spot configuration in the screen periphery indicated by FIG. 3.

The gun system according to the invention offers many benefits. For example, deflection defocusing astigmatism (shown by FIG. 3 is reduced; this is an aberration that dynamic focusing without the inventive means cannot remedy, nor can it be ameliorated by static control of the focus voltage. The system according to the invention also offer means for the elimination of convergence variations in vertical lines at the three and nine o'clock positions. Elimination is accomplished by adjusting the dynamic focus waveform amplitude by circuit means. For example, potentiometer adjustments can be used to change waveshapes to accomplish convergence of the lines at three and nine o'clock. Another benefit is that dynamic convergence is accomplished by the same waveform that accomplishes dynamic focus.

The system according to the invention makes possible the use of a self-converging yoke with the planar mask cathode ray tube. Without the system according to the invention, the self-converging field of the yoke would have to be made much stronger to attain beam convergence at the peripheries of the flat faceplate, but at the cost of greatly enhanced distortion due to deflection defocusing. The self-converging electron gun system according to the invention provides for beam convergence even at the edges of the screen to reduce the self-convergence demands on the yoke.

A reduced strength of the non-uniform yoke field component may be achieved, resulting in a yoke of lesser aberration, and therefore lower cost. For example, if an $x^2+y^2$ focus waveform is employed, yoke aberration in the horizontal and vertical coils can then be reduced. On the other hand, if an $x^2$ focus waveform is employed, yoke aberration in the horizontal coil can then be reduced.

While particular embodiments of the invention have been shown and described, it will be readily apparent to those skilled in the art that changes and modifications may be made in the inventive means without departing from the invention in its broader aspects. For example, various embodiments have been described supra which illustrate the principles of the invention as applicable to guns of many different types—bipotential, extended field, and even guns of the type wherein the first electrode in the main focus lens has an intermediate potential, followed by a focus electrode receiving a lower potential, with the succeeding electrodes receive increasing potentials (the FIG. 8 embodiment). These embodiments show that a number of techniques can be used for creating the asymmetric fields having the strengths necessary to achieve the aforedescribed strong dependence of convergence on changes in focus voltage. The embodiments set forth illustrate that offset apertures may be employed as well as electrode gaps having angled plano-parallel orientations. The invention could equally be applied to embodiments using wedge-shaped gaps to create asymmetric fields. The polarity of the asymmetric fields, that is, the direction in which the fields cause the beam to deflect in order to achieve the objectives of the invention, is of course determined by whether the beam is decelerating or accelerating as its passes through an asymmetirc field. The degree of offsetting of the apertures, or the angle of the plano-parallel gap faces or wedge face angles determine, for a given intervening field strength, the amount of beam deflection which will be produced by an asymmetrical field component. Other techniques might be devised in consonance with the inventive principles for causing the beam to bend to a greater or lesser degree in correspondence with changes in the focus voltage. The particular polarities of the asymmetric fields at the various electrode gaps will vary depending on the pattern of voltages applied to the electrodes and the mechanism used to cause beam divergence or deflection. However, what is important is that the geometry is such as to cause the beam at each asymmetric field to bend in a direction such as to augment the dependence of the system convergence on changes in focus voltage.

The aim of the appended claims is to cover all such changes and modifications as fall within the true spirit and scope of the invention.

We claim:

1. An electron gun system for a color cathode ray tube comprising:

means including cathode means for developing an electron beam;

main focus lens means for receiving said electron beam and forming a focused electron beam spot at the screen of the tube, said main focus lens means having a plurality of electrodes situated on a common axis;

means for developing and applying to said electrodes potentials effective to form one or more focusing field components between said electrodes;

said lens means being so structured and arranged as to cause to be formed between adjacent electrodes at least one focusing field component effective to significantly divert a passed beam from a straight-line path through a predetermined angle; and means for developing and applying a varying voltage to at least one of said electrodes to cause the strength of said asymmetric field component, and thus said angle by which said beam is diverted, to vary in response to said varying voltage.

2. An electron gun system for a color cathode ray tube having a screen and comprising:

means including cathode means for developing three electron beams;

three main focus lens means for receiving said electron beams and forming three focused electron beam spots at the screen of the tube, said main focus lens means each having a plurality of electrode means spaced along a lens axis parallel to the other lens axes and parallel to a gun central axis, at least two of which lens axes are off-axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to converge the off-axis beams in the vicinity of the screen; and means for developing a voltage having amplitude variations correlated with a scan of the beams across the screen and for applying said voltage to at least one of said electrodes of each of said focus lens means to cause the strength of said asymmetrical field components affecting said off-axis beams, and thus the distance from the gun at which the beams converge, also to vary, whereby in addition to dynamically focusing all the beams, the voltage having amplitude variations also provides a measure of beam convergence.

3. An electron gun system for a color cathode ray tube having a screen and comprising:

means including cathode means for developing three electron beams;

three main focus lens means for receiving said electron beams and forming three focused electron beam spots at the screen of the tube, said main focus lens means each having a plurality of electrode means, including focus electrode means, spaced along a lens axis parallel to the other lens axis and parallel to a gun central axis, at least two of which lens axes are off-axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to converge the off-axis beams in the vicinity of the screen; and means for developing a dynamic focus voltage having amplitude variations correlated with a scan of the beams across the screen, and for applying said voltage to said focus electrode means of each said lens means to cause the focal distance of each of said beams to vary, while at the same time to cause the strength of said asymmetrical field components affecting said off-axis beams, and thus the distance from the gun at which the beams converge, also to vary, whereby in addition to focusing all the beams, the dynamic focusing voltage also provides a measure of beam convergence.

4. A color cathode ray tube system having a screen with multi-color light-emitting phosphor elements thereon, comprising:

means for partially dynamically converging the beams as a function of location of the beams on the screen; and an electron gun systém, comprising:

means including cathode means for developing three electron beams;

three main focus lens means for receiving said electron beams and forming three focused electron beam spots at the screen of the tube, said main focus lens means each having a plurality of electrode means, including focus electrode means, spaced along a lens axis parallel to the other lens axes and a parallel to a gun central axis, at least two of which lens axes are off-axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to partially converge the off-axis beams in the vicinity of the screen; and means for developing a dynamic focus voltage having amplitude variations correlated with a scan of the beams across the screen, and for applying said voltage to focus electrode means of each of said lens means to cause the focal distance of each of said beams to vary, and to cause the strength of said asymmetrical field components affecting said off-axis beams, and thus the distance from the gun at which the beams converge, also to vary, whereby the dynamic focus voltage of the gun system, in addition to focusing all the beams, supplements the partial beam convergence provided by the beam converging means to also provide a measure of beam convergence.

5. A color cathode ray tube system having a screen with multi-color light-emitting phosphor elements thereon, said tube system comprising:

self-converging yoke means;

a three-beam, in-line electron gun system for exciting said phosphor elements, comprising:

means including cathode means for developing said beams;

three main focus lens means for receiving said electron beams and forming three focused electron beam spots at the screen of the tube, said main focus lens means each having a plurality of electrode means, including focus electrode means, spaced along a lens axis parallel to the other lens axes and parallel to a gun central axis, one of which lens axes lies on said central axis, and two of which lens axes are off-axis axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to converge the off-axis beams at the screen; and means for developing a dynamic focus voltage having amplitude variations correlated with a scan of the beams across the screen, and for applying said voltage to focus electrode means of each of said focus lens means to cause the focal distance of each of said beams to vary, and to cause the strength of said asymmetrical field components affecting said off-axis beams, and thus the distance from the gun at which the beams converge, also to vary, whereby the application of the dynamic focus voltage, in addition to focusing all the beams, provides an additional measure of beam convergence to reduce the self-convergence demands on the yoke.

6. A color cathode ray tube system with a substantially flat faceplate and an associated flat tension shadow mask, said faceplate having a screen with multi-color light-emitting phosphor element thereon, said tube system comprising:

self-converging yoke means;

a three-beam electron gun system for exciting said phosphor elements, comprising:

means including cathode means for developing said beams;

three main focus lens means for receiving said electron beams and forming three focused electron beam spots at the screen of the tube, said main focus lens means each having a plurality of electrode means, including focus electrode means, spaced along a lens axis parallel to the other lens axes and parallel to a gun central axis, one of which lens axes lies on said central axis, and two of which lens axes are off-axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to converge the off-axis in the vicinity of the screen; and means for developing a dynamic focus voltage having amplitude variations correlated with a scan of the beams across the screen, and for applying said voltage to focus electrode means of each of said focus lens means to cause the focal distance of each of said beams to vary, and to cause the strength of said asymmetrical field components affecting said off-axis beams, and thus the distance from the gun at which all the beams converge, also to vary, whereby the application of the dynamic focus voltage, in addition to focusing the beams, provides an additional measure of beam convergence to reduce the extraordinary demands on the self-converging yoke which result from the flatness of the faceplate.

7. A color cathode ray tube system with a curved faceplate having a screen with multi-color light-emitting phosphor elements thereon, said tube system comprising:

self-converging yoke means;

a three-beam electron gun system for exciting said phosphor elements, comprising:

means including cathode means for developing said beams;

three main focus lens means for receiving said electron beams and forming three focused electron beam spots at the screen of the tube, said main focus lens means each having a plurality of electrode means, including focus electrode means, spaced along a lens axis parallel to the other lens axes and parallel to a gun central axis, one of which lens axes lies on said central axis, and two of which lens axes are off-axis with respect to said gun central axis;

means for developing and applying to said electrode means of each of said main focus lens means potentials which form one or more field components between said electrode means;

said off-axis main focus lens means each being so structured and arranged as to cause at least one of said field components to be asymmetrical and effective to converge the off-axis beams in the vicinity of the screen; and means for developing a dynamic focus voltage having amplitude variations correlated with a scan of the beams across the screen, and for applying said voltage to focus electrode means of each of said focus lens means to cause the focal distance of each of said beams to vary, and to cause the strength of said asymmetrical field components affecting said off-axis beams, and thus the distance from the gun at which the beams converge, also to vary, whereby the application of the dynamic focus voltage, in addition to focusing all the beams, provides an additional measure of beam convergence to reduce the demands on the self-converging yoke.

8. For use with a color CRT system, an electron gun system providing beam convergence, comprising:

means including cathode means for developing three electron beams parallel to the center axis of the gun, two of which are off-axis with respect to the center axis;

a plurality of electrode means for each beam for shaping and focusing and assisting in the convergence of said beam at the screen of the tube;

means for developing and applying to said plurality of electrode means a pattern of potentials which form field components in the gaps therebetween;

means for developing and applying a varying dynamic focus voltage to at least one of said electrode means for each beam for dynamically focusing said beams as they are deflected across said screen, at least selected ones of said plurality of electrode means for each of said off-axis beams being so structured and arranged as to cause a plurality of said field components to be asymmetric and effective to converge said off-axis beams, the strength of said asymmetric field components varying in response to changes in said dynamic focus voltage applied to said electrode means, said asymmetric field components having such polarity and strength, due to said structuring and arranging of said electrodes, and the application of said pattern of voltages, that a change in the level of said dynamic focus voltage causes a change in the strength of said asymmetric field components in a direction effective to additively deflect a common off-axis beam in a common angular direction so as to create an enhanced dependency of the convergence of said off-axis beams on variations in said focus voltage.

9. For use with a color CRT system having a self-converging yoke, an electron gun system assisting in providing beam convergence to reduce the self convergence demands on the yoke, the system comprising:

means including cathode means for developing three electron beams parallel to the center axis of the gun, two of which are off-axis with respect to the center axis;

a plurality of electrode means for each beam for shaping and focusing and assisting in the convergence of said beam at the screen of the tube;

means for developing and applying to said plurality of electrode means a pattern of potentials to form field components in the gaps between the electrodes;

means for developing and applying a varying dynamic focus voltage to at least one of said electrode means for each beam for dynamically focusing said beams as they are deflected across said screen, at least selected ones of said plurality of electrode means for each of said off-axis beams being so structured and arranged as to cause a plurality of said field components to be asymmetric and effective to converge said off-axis beams, the strength of said asymmetric field components varying in response to changes in said dynamic focus voltage applied to said electrode means, said asymmetric field components having such polarity and strength, due to said structuring and arranging of said electrodes, and the application of said pattern of voltages, that a change in the level of said dynamic focus voltage causes a change in the strength of each of said asymmetric field components in a direction effective to additively deflect a common off-axis beam in a common angular direction so as to create a strong dependency of the convergence of said off-axis beams on variations in said focus voltage, whereby a portion of the self convergence desired to be attained in said CRT system is achieved by the converging of said beams as said beams are dynamically focused to thereby reduce the self-convergence demands on the yoke.

10. For use with a color CRT system having a self-converging yoke, an electron gun system assisting in providing beam convergence to reduce the self-convergence demands on the yoke, the system comprising:

means including cathode means for developing three electron beams parallel to the center axis of the gun, two of which are off-axis with respect to the center axis;

main focus lens means for each beam for receiving said beams and for focusing and assisting in the convergence of said beams at the screen of the tube, said focus lens means for each beam including at least focus electrode means and second electrode means adjacent to said focus electrode means on the side away from said cathode means;

third electrode means for each beam located adjacent to said focus electrode means on the side toward said cathode means;

means for developing and applying to said focus electrode means and to said second and third electrode means a pattern of potentials which form first and second field components in the gaps between said third electrode means and said focus electrode means and between said focus electrode means and said second electrode means, respectively;

means for developing and applying a varying dynamic focus voltage to said focus electrode means for each beam for dynamically focusing said beams as they are deflected across said screen, said third electrode means and said focus electrode means, and said focus electrode means and said second electrode means for each of said off-axis beams being so structured and arranged as to cause said field components therebetween to be asymmetric and effective to converge said off-axis beams, the strength of said first and second asymmetric field components varying in response to changes in said dynamic focusing voltage applied to said focus electrode, said asymmetric field components having such polarity and strength, due to said structuring and arranging of said electrodes, and the application of said pattern of voltages, that a change in the level of said dynamic focus voltage causes a change in the strength of each of said asymmetric field components in a direction effective to additively deflect a common off-axis beam in a common angular direction so as to create a strong dependency of the convergence of said off-axis beams on variations in said focus voltage, whereby a portion of the self convergence desired to be attained in said CRT system is achieved by the converging of said beams as said beams are dynamically focused to thereby reduce the self-convergence demands on the yoke.

11. For use with a color CRT system having self-converging yoke, an electron gun system assisting in providing beam convergence to reduce the self-convergence demands on the yoke, the system comprising:

means including cathode means for developing three electron beams parallel to a center axis of the gun, two of which are off-axis with respect to the center axis;

main focus lens means for each beam for receiving said beams and for focusing and assisting in the convergence of said beams at the screen of the tube, said main focus lens means for each beam including at least focus electrode means and second electrode means adjacent to said focus electrode means on the side away from said cathode means;

third electrode means for each beam located adjacent to said focus electrode means on the side toward said cathode means;

means for developing and applying to said focus electrode means and to said second and third electrode means a pattern of potentials which form first and second field components in the gaps between said third electrode means and said focus electrode means and between said focus electrode means and said second electrode means, respectively;

means for developing and applying a varying dynamic focus voltage to said focus electrode means for each beam for dynamically focusing said beams as they are deflected across said screen, the addressing faces and/or apertures of said third electrode means and said focus electrode means, and the addressing faces and/or apertures of said focus electrode means and said second electrode means for each of said off-axis beams being so structured and arranged as to cause said asymmetric field components therebetween to be asymmetric and effective to converge said off-axis beams, the strength of said first and second asymmetric field components varying in response to changes in said dynamic focusing voltage applied to said focus electrode, said asymmetric field components having such polarity and strength, due to said structuring and arranging of said electrodes, and the application of said pattern of voltages, that a change in the level of said dynamic focus voltage cause a change in the strength of each of said asymmetric field components in a direction effective to additively deflect a common off-axis beam in a common angular direction so as to create a strong dependency of the convergence of said off-axis beams on variations in said focus voltage, whereby a portion of the self convergence desired to be attained in said CRT system is achieved by the converging of said beams as said beams are dynamically focused to thereby reduce the self-convergence demands on the yoke.

12. The color CRT display system according to claim 11 wherein said addressing faces are parallel and angled relative to said central axis so as to create said asymmetry in field components.

13. The color CRT display system according to claim 11 wherein at least one of said asymmetric field components is created by the offsetting of said apertures.

14. The color CRT display system according to claim 11 wherein at least one aperture adjacent to one of said asymmetric field components is offset from said central axis to create the asymmetric field, and wherein the addressing faces of the electrodes adjacent to the other asymmetric field components are parallel and angled relative to said central axis to create said other asymmetric field.

15. For use with a color CRT system having a self-converging yoke, an electron gun system having a three-element extended field main focus lens, said gun system assisting in providing beam convergence to reduce the self-convergence demands on the yoke, the system comprising:

means including cathode means for developing three electron beams parallel to the center axis of the gun, two of which are off-axis with respect to the center axis;

main focus lens means for each beam for receiving said beams and for focusing and assisting in the convergence of said beams at the screen of the tube, said focus lens means for each beam including at least focus electrode means, anode electrode means, and at least one intermediate electrode situated between said focus electrode means and said anode electrode means; prefocus electrode means for each beam located adjacent to said focus electrode means on the side toward said cathode means;

means for developing and applying to said prefocus electrode means, said focus electrode means, said anode electrode means and said intermediate electrode means, a pattern of potentials which form first and second field components in the gaps between said prefocus electrode means and said focus electrode means, and between said focus electrode means and said intermediate electrode means, respectively;

means for developing and applying a varying dynamic focus voltage to said focus electrode means for each beam for dynamically focusing said beams as they are deflected across said screen, said prefocus electrode means and said focus electrode means, and said focus electrode means and said intermediate electrode means for each of said off-axis beams being so structured and arranged as to cause said field components therebetween to be asymmetric and effective to converge said off-axis beams, the strength of said first and second asymmetric field components varying in response to changes in said dynamic focusing voltage applied to said focus electrode, said asymmetric field components having such polarity and strength, due to said structuring and arranging of said electrodes, and the application of said pattern of voltages, that a change in the level of said dynamic focus voltage causes a change in the strength of each of said asymmetric field components in a direction effective to additively deflect a common off-axis beam in a common angular direction so as to create a strong dependency of the convergence of said off-axis beams on variations in said focus voltage, whereby a portion of the self convergence desired to be attained in said CRT system is achieved by the converging of said beams as said beams are dynamically focused to thereby reduce the self-convergence demands on the yoke.

16. For use with a color CRT system having a self-converging yoke, an electron gun system having a four-element main focus lens, said gun system assisting in providing beam convergence to reduce the self-convergence demands on the yoke, the system comprising:

means including cathode means for developing three electron beams parallel to the center axis of the gun, two of which are off-axis with respect to the center axis;

main focus lens means for each beam for receiving said beams and for focusing and assisting in the convergence of said beams at the screen of the tube, said focus lens means for each beam including at least a first, second, third, and fourth electrode means with prefocus electrode means for each beam located adjacent to said first electrode means on the side toward said cathode means;

means for developing and applying to said electrode means a pattern of potentials which form field components in the gaps therebetween, said pattern of potentials following the relationship: first electrode means—medium; second electorde means—low; third electrode means—medium; fourth electrode means—high;

means for developing and applying a varying dynamic focus voltage to said second electrode means for each beam for dynamically focusing said beams as they are deflected across said screen, said first electrode means and said second electrode means, and said second electrode means and said third electrode means for each of said off-axis beams being so structured and arranged as to cause said field components therebetween to be asymmetric and effective to converge said off-axis beams, the strength of said asymmetric field components varying in response to changes in said dynamic focusing voltage applied to said focus electrode, said asymmetric field components having such polarity and strength, due to said structuring and arranging of said electrodes, and the application of said pattern of voltages, that a change in the level of said dynamic focus voltage causes a change in the strength of each of said asymmetric field components in a direction effective to additively deflect a common off-axis beam in a common angular direction so as to create a strong dependency of the convergence of said off-axis beams on variations in said focus voltage, whereby a portion of the self convergence desired to be attained in said CRT system is achieved by the converging of said beams as said beams are dynamically focused to thereby reduce the self-convergence demands on the yoke.

* * * * *